United States Patent [19]

Anderson

[11] 4,022,327

[45] May 10, 1977

[54] WINE RACK

[76] Inventor: Peter B. Anderson, 101 Lynbrook Ave., Lynbrook, N.Y. 11563

[22] Filed: Oct. 16, 1975

[21] Appl. No.: 622,883

[52] U.S. Cl. ..... 211/74; 211/186
[51] Int. Cl.[2] ..... A47B 73/00
[58] Field of Search ..... 211/71–75, 211/148, 177, 186–189; 248/150; 108/106–109, 92, 96, 101

[56] References Cited

UNITED STATES PATENTS

| | | | |
|---|---|---|---|
| 2,438,324 | 3/1948 | Pfeffer | 211/177 |
| 3,204,867 | 9/1965 | Wahlbom | 211/74 X |
| 3,606,023 | 9/1971 | Edmunds | 211/177 X |

FOREIGN PATENTS OR APPLICATIONS

| | | | |
|---|---|---|---|
| 670,136 | 4/1952 | United Kingdom | 211/74 |
| 1,330,786 | 9/1973 | United Kingdom | 211/74 |

*Primary Examiner*—Roy D. Frazier
*Assistant Examiner*—Terrell P. Lewis
*Attorney, Agent, or Firm*—Natter & Natter

[57] ABSTRACT

An improved wine rack having a plurality of vertical standards for supporting cantilevered bottle holders. The bottle holders interlockingly engage the standards and are consecutively spaced in horizontal rows and in vertical alignment to form bottle berths adapted for accommodating a wide range of bottle shapes and sizes. The confronting edges of adjacent coplanar bottle holders provide cooperative cradling surfaces for laterally supporting therebetween a bottle resting on its side.

8 Claims, 7 Drawing Figures

FIG. 4
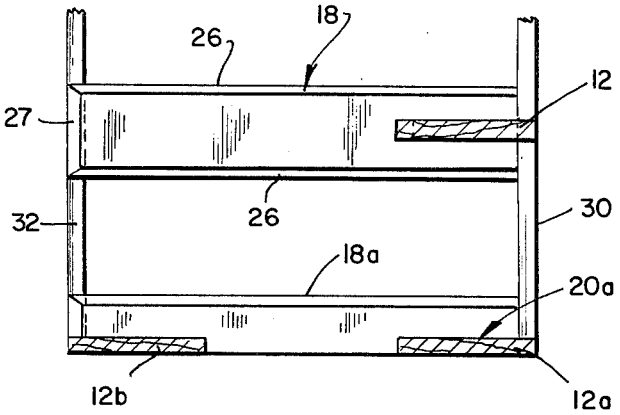
FIG. 6
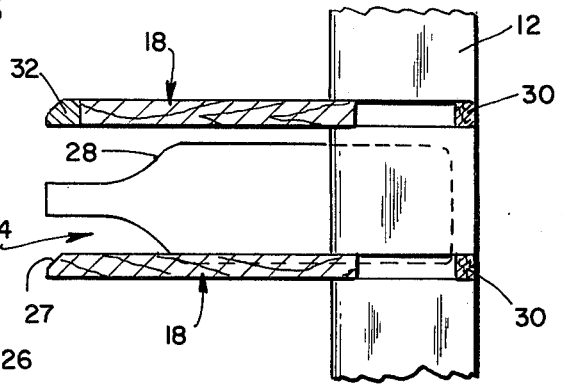
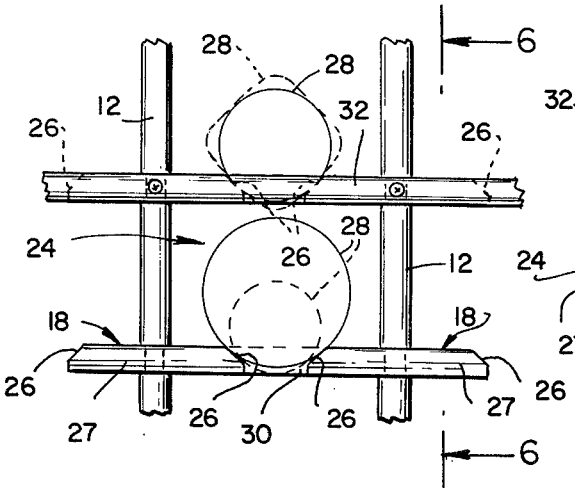
FIG. 5
FIG. 7
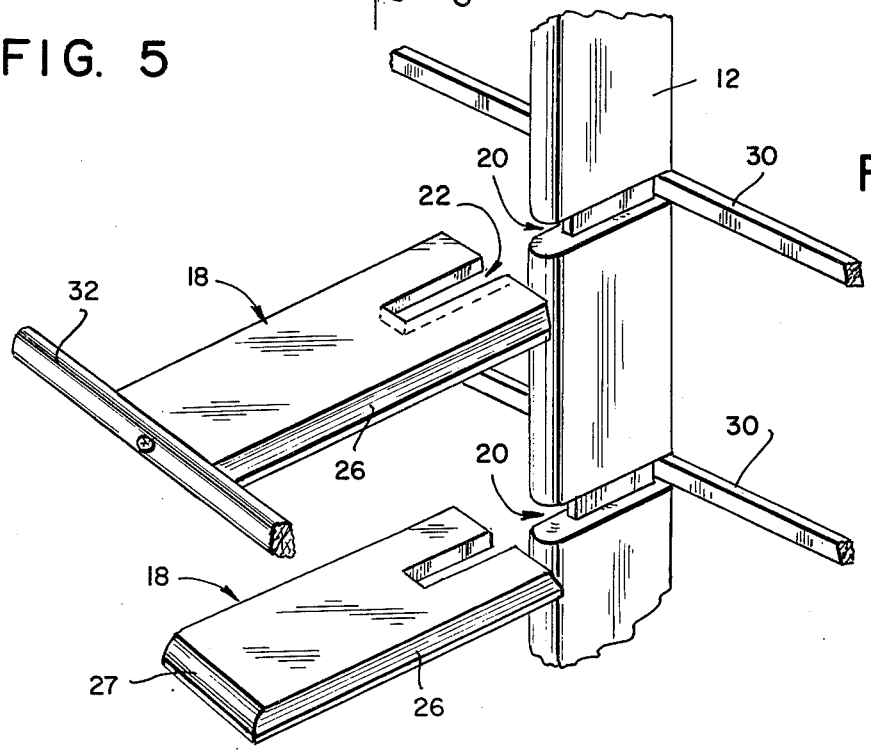

WINE RACK

BACKGROUND OF THE INVENTION

1. Field of The Invention

The invention relates generally to bottle holders and especially to wine bottle storage.

In particular, this invention concerns a wine rack for supporting a plurality of bottles lying on their sides.

2. Description of the Prior Art

The proper storage of bottled wines, spirits and beers is important since these beverages can represent a sizable investment especially when large purchases are involved; therefore they should be treated with care and due regard for their perishable qualities. The generally accepted manner for storing wines in order to keep the wine "healthy" is to place the bottle in a bin so that it rests on its side and the cork stays moist. This prevents the cork from drying out and allowing air to enter the bottle; with sparkling wines a dried out cork permits the gas to escape resulting in a "flat" wine. Ideally, the bins should be located in a well ventilated, cool, dark place having a fairly constant temperature of about 55° to 60° F.

The storage facility should be designed so as to avoid unnecessary movement or vibration of the bottles which can disturb the sediment therein.

The wine bins or racks of the prior art conventionally provide a bottle cradling surface transverse to the bottle for supporting the bottle usually at two points, at the neck portion and near the bottom. Many of these racks are erected with a honeycomb framework being made of metal, plastic or wood sections which are assembled to form a support stand. These structures commonly provide a support surface which is recessed to conform to a particular bottle shape. Other variations in design such as a diagonal cross braced structure are also utilized wherein the bottles are stored within a cross-cross bin shaped opening. Such devices, however, are limited in the range of different shape bottles which they can accommodate and in their storage capacities. This restriction on the type and quantity of bottles which can be stored is a distinct shortcoming of the prior art.

Furthermore, these wine racks in many cases do not provide the stability necessary to prevent joggling of the bottles. Another shortcoming of these wine racks is that the bottle supporting surface, especially that portion adjacent the bottle neck, frequently obscures the labels on the bottles and consequently a bottle must be provided with special tags or otherwise lifted from the rack in order to ascertain this identifying data. Such unnecessary movement of the wine bottles can have an adverse effect and is not recommended for proper wine storage.

The improved wine rack of this invention overcomes many of these problems and accordingly provides a stable, free-standing rigid support structure for the storage of wine bottles. The bottles as supported on their sides can be easily slid out of the rack without disturbance of adjacent bottles. Furthermore, the rack of the present inventiion has a plurality of bottle berths which can accommodate a wide range of different bottle shapes and sizes. Another advantage of this wine rack is that the bottle berths are arranged such that the bottle labels are more clearly visible thus avoiding the need to remove a bottle for identification or to otherwise affix hang tags.

A further feature of this wine rack is that the support structure is comprised of relatively few basic components which can easily be assembled. The rack is also adaptable for accepting supplementary sections for expanding the storage capacity.

SUMMARY OF THE INVENTION

Briefly, the bottle storage rack of this invention is directed to a support structure for free-standing or wall-mounted installation. The wine rack is designed with interfitting components which can be readily assembled.

Basically, the instant wine rack incorporates a system of vertical, load-bearing standards which frame into a top and a bottom rail. The standards are provided with dadoes or channels which support cantilevered shelves or bottle holders having a slotted opening for press-fit interlock with the standards. The bottle holders are consecutively spaced in horizontal rows and vertically aligned thus forming bottle berths for accommodating a wide range of bottle shapes and sizes. The confronting edges of adjacent coplanar bottle holders provide cooperative cradling surfaces for laterally supporting therebetween a bottle resting on its side.

The introduction of horizontal thrust transfer members connecting a coplanar horizontal row of bottle holders provides added structural integrity and braces the rack to reduce sway movement.

Additionally, bottle stop members are affixed to the rear of the rack to provide a protective barrier and increase the lateral strength. Thus the wine rack of this invention provides a rigid framework for supporting wine bottles in an environment which will reduce unnecessary vibration or movement of the bottles and contents therein.

The basic wine rack design is such that the components may be varied in length and size for providing racks as small as one bottle berth in width and extending vertically between two standards or one bottle berth in height extending horizontally. Other combinations will be apparent thus permitting the wine rack to be arranged for meeting space and storage capacity requirements. The support structure described in also particularly adaptable for the later incorporation of supplemental banks of bottle holders so that the wine rack can be expanded when necessary in either a horizontal or vertical direction in accordance with subsequent conditions.

These features along with the relatively easy assembly procedure make the wine rack ideal for private collectors, especially those having limited space for storage of wine bottles. The wine rack may conveniently be erected in a closet, cupboard, basement or other available area and can even be framed around a window opening or enclosed to form a wine vault. The storage capacity can be increased as previously mentioned, and the wine rack can also be conveniently used for commercial purposes, such as in restaurants, wine shops, liquor stores, hotels, etc., since the bottles are openly displayed and the inventory is more readily accessible than with the previously used wine racks.

It should also be noted that since the wine bottle is laterally supported along its body in the bottle berth, the neck of each bottle does not contact a support edge. The open space in the neck area of the bottles facilitates inspection of the bottles prior to removal. It should therefore be apparent that this improved bottle access facility is an important feature especially to the wine connoisseur.

Having thus summarized the invention, it will be seen that an object thereof is to provide a wine rack of the general character described herein.

Specifically, it is an object of this invention to provide a wine rack having component elements which can be interfitted for assembling a support structure for the storage of wine bottles.

It is also an object of this invention to provide a wine rack including a plurality of vertically spaced load-bearing standards supporting cantilevered bottle holders forming bottle berths.

Another object of this invention is to provide a wine rack wherein the wine bottles are laterally supported between the cantilevered bottle holders.

Still another object of this invention is to provide a wine rack having bottle berths which can accommodate a wide range of bottle sizes and shapes.

A further object of this invention is to provide a wine rack which minimizes disturbance of the bottles by incorporating a system of lateral bracing for reducing sway and other movement.

Still another object of this invention is to provide a wine rack having bottle berths with an unsupported bottle neck portion to facilitate bottle access.

The above and other objects, features, and advantages of this invention will be apparent from the following description of the preferred embodiment when considered in connection wIth the accompanying drawings.

DETAILED DESCRIPTION OF THE DRAWINGS

In the accompanying drawings in which is shown the preferred embodiment of this invention:

FIG. 4 is an enlarged sectional view taken substantially along line 4—4 of FIG. 2 and shows in plan a framing detail of the end section and also shows a lateral tie member for connecting two bottle holders;

FIG. 5 is an isolated front elevational view and shows to an enlarged scale typical bottle berths including the wine bottles in place; two different shaped bottles are indicated in broken lines;

FIG. 6 is a sectional view taken substantially along line 6—6 of FIG. 5 and shows a bottle within a berth and resting against a bottle stop; and FIG. 7 is an exploded view and shows the interfitting relationship between the assembled components.

DETAILED DESCRIPTION OF THE INVENTION

Figure 1:
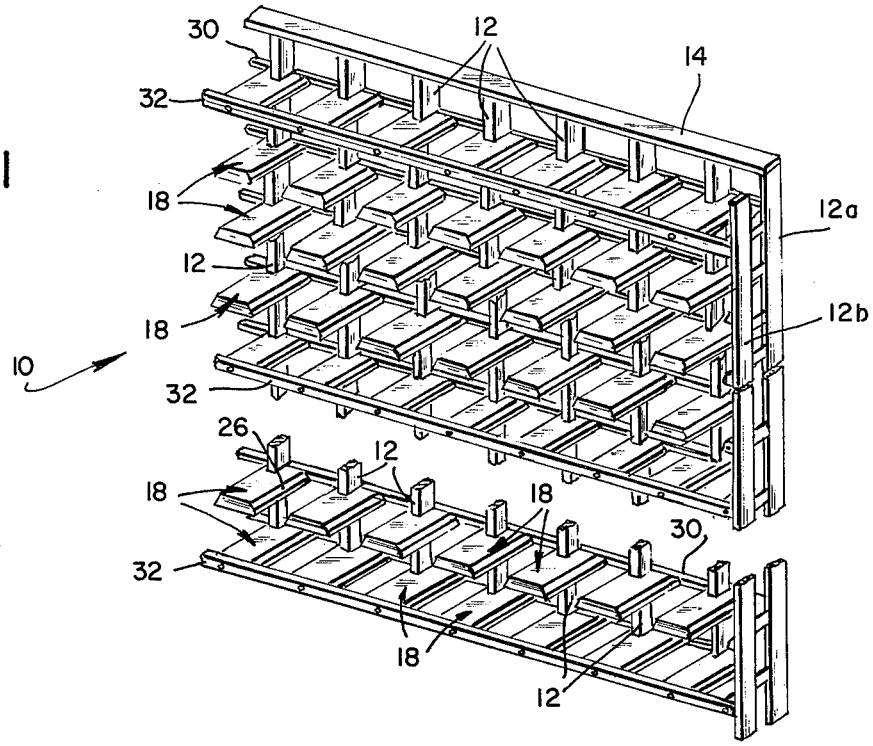
FIG. 1 is a perspective view of a wine rack of this invention.

Referring now in detail to the drawings, the reference numeral 10 refers generally to an improved wine bottle storage rack of this invention. The wine bottle rack 10 is designed to be assembled with basic interfitting components and can be a self-supporting structure with free-standing legs; however auxiliary fastening devices such as a mounting plate can be utilized if it is desired that the rack 10 be wall mounted or affixed to another support.

Figure 2:
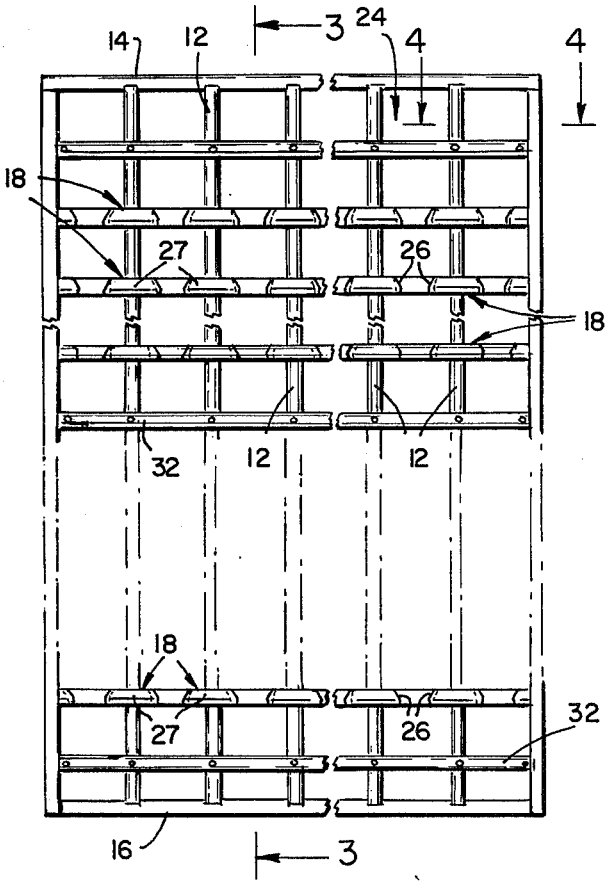
FIG. 2 is a front elevational view of the wine rack and shows vertical load-bearing standards supporting consecutively spaced bottle holders which form bottle berths.
Figure 3:
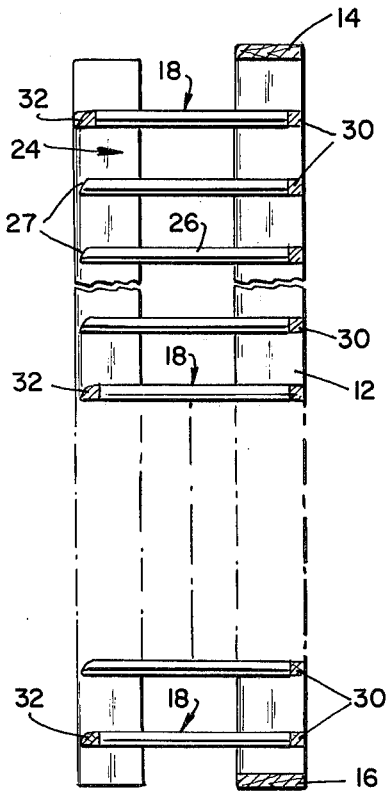
FIG. 3 is a sectional view taken substantially along line 3—3 of FIG. 2 and shows in elevation the spacing between and vertical alignment of the bottle holders.

The wine rack 10 is constructed of a framework having as one of its components an upright or standard 12. A plurality of standards 12 are spaced parallel to each other and frame into an upper or top rail 14 and a lower or bottom rail 16, each of the rails 14, 16 being horizontally oriented. Each of the standards 12 is adapted to support a cantilevered bottle holder 18. For this purpose the standard 12 is doubled dadoed or otherwise provided with a peripheral groove 20 at selected elevations along its height. The bottle holders 18 have channels or slotted openings 22 which are adapted for press-fit engagement with the corresponding front portion of grooves 20 as noted in the illustration of FIG. 7. A glue or other adhesive may be used to secure the interlock between the bottle holders 18 and the standards 12. The wine rack 10 can thus be assembled with consecutively spaced, coplanar, horizontal and vertical rows of bottle holders 18 forming compartments or bottle berths 24 as shown in FIG. 2.

As noted in FIGS. 4 and 5, the width of the corresponding bottle holders 18 in each horizontal row is less than the space between the standards 12, and thus a cradling gap is provided between the confronting edges of the bottle holders 18. These edges preferably are bevelled or contoured generally conform to and from a cradling surface 26 for securely holding a wine bottle 28 therebetween. Additionally, the bottle holders 18 are provided with a rounded nose 27.

The two endmost bottle holders of each horizontal row are constructed with a modified bottle holder **18*a* having a notched area 20*a* for complementary fit with an exterior standard 12*a*. An additional exterior standard 12*b* is also optionally deployed in interfitting relationship with the modified bottle holder 18*a*** to provide supplemental support and stability to the rack structure.

Referring now to the groove 20 at the rear of standard 12, a horizontal backing strip 30 is affixed within the groove 20 and extends transversely across the rack 10 in registration with the cradling gap. This backing strip 30 functions as a bottle stop or protective barrier to prevent the bottle 28 from being pushed too far back in the bottle berth 24 or sliding through the rack 10. The bottle 28 in FIG. 6 is shown lying on its side in a bottle berth 24 and supported between two cradling surfaces 26 of respective bottle holders 18; the backing strip 30 checks rearward movement. The backing strips 30 also form part of the bracing system for providing lateral stability to the rack 10.

In order to prevent any swaying movement of the rack 10 and to otherwise compensate for lateral thrust, a bracing system including a lateral tie member 32 connects consecutive coplanar bottle holders 18 and frames into standards **12*b*. A length of stock is removed from the rounded nose 27 to allow for mounting of the member 32. The lateral tie members 32** are preferably placed along every sixth horizontal row, however this can be varied depending on the load conditions.

As previously noted, a feature of this invention is that the cantilevered bottle holders 18 provide a continuous lateral support along two sides of the body of the bottle 28 and can accommodate various size and shape bottles. Many different shape and size bottles are currently available for wine, spirits, and beers. In particular, table wines are known to be bottled in various shape bottles such as Bordeaux type, Burgundy type, German type, Fiasco (raffi-covered) and Champagne type. Further, each of these bottle shapes come in different sizes.

Champagne bottles, for instance, for containing sparkling wines come in quadruple magnum (height 580 mm., diameter 164 mm.), triple magnum (height 540 mm., diameter 152 mm.), double magnum (height 475.7 mm., diameter 137.5 mm.), and magnum (height 385.2 mm., diameter 115.5 mm.). The horizontal and vertical spacing between bottle holders 18 can be varied so that the bottle berth 24 is flexible enough to accommodate a multiplicity of different size bottles. By way of illustration, FIG. 5 shows the accommodation of different shaped bottles indicated in both the solid and broken lines. Additionally, since the wine rack 10 does not rely on a transverse support system and the cradling of the bottle neck, additional space is provided between the bottles around the neck area for facilitating access to the bottles. The open space can also be used in aiding visual identification without first removing a bottle from the rack and further allows adequate ventilation between the bottles and sufficient air circulation for maintaining a substantially constant storage temperature.

As other possible embodiments might be made of the present invention and as various changes might be made in the embodiment as set forth, it is to be understood that all matter herein described or shown in the accompanying drawings is to be interpreted as illustrative and not in a limiting sense.

Having thus described the invention, there is claimed as new and desired to be secured by Letters Patent:

1. A bottle rack for the storage and display of wine bottles comprising at least two vertically supported load bearing standards, a plurality of bottle holders, said standards having selectively located recessed portions along their height for receiving said bottle holders, the bottle holders having slotted openings for interlocking engagement within said recessed portions to provide cantilevered support with the bottle holders being consecutively spaced to define a cradling gap between successive pairs of bottle holders and further including a barrier strip extending transversely between said standards, said barrier strip being positioned rearwardly of the bottle holders and in registration with the cradling gap to provide a protective bottle stop, said barrier strip being secured within said recessed portions on the standards.

2. A bottle rack as claimed in claim 1 further including a plurality of standards wherein the bottle holders are attached to coplanar horizontal rows and are aligned in vertical columns.

3. A bottle rack as claimed in claim 2 further including a lateral tie member connecting selected horizontal rows of bottle holders to provide bracing for lateral thrust to prevent swaying movement of the rack.

4. A bottle rack as claimed in claim 2 further including a top and a bottom rail wherein the standards are framed into the respective rails to provide structural rigidity to the rack.

5. A bottle rack as claimed in claim 2 further including a modified bottle holder for the endmost position of each horizontal row and framing into an exterior standard and further including an additional exterior standard for providing added stability to the rack.

6. A bottle rack as claimed in claim 1 wherein the cradling gap is further defined by a pair of confronting edge surfaces of adjacent bottle holders, said confronting edge surfaces providing lateral support for holding a bottle therebetween.

7. A bottle rack as claimed in claim 6 wherein the confronting edges substantially conform to the bottle shape and provide cradling surfaces for supporting the bottle.

8. A bottle rack for the storage and display of wine bottles having interlocking assembly of component parts and being comprised of at least two vertically supported load bearing standards, a plurality of bottle holders, said standards having selectively located fastening means along their height for receiving a first end of each of said bottle holders, the bottle holders having complementary attachment means at said first end thereof, said attachment means being adapted for interfitting engagement with the fastening means to provide cantilevered support for the bottle holders with an opposite free end of each of said bottle holders being unsupported, said bottle holders being positioned in horizontal co-planarity and consecutively spaced to define a cradling gap between successive pairs of bottle holders for accommodating a wide range of bottle shapes and sizes and barrier means in registration with the cradling gap for providing a limit stop for bottles placed in the rack.

* * * * *